US005160581A

United States Patent [19]

Titmas

[11] Patent Number: 5,160,581

[45] Date of Patent: Nov. 3, 1992

[54] METHOD FOR OXYGEN BLEACHING PAPER PULP

[75] Inventor: James A. Titmas, Kent, Ohio

[73] Assignees: Titmas and Associates Incorporated; Waste Safety International, Inc., Hudson, Ohio

[21] Appl. No.: 531,551

[22] Filed: Jun. 1, 1990

[51] Int. Cl.[5] ..... D21C 9/147

[52] U.S. Cl. ..... 162/61; 162/65; 166/300; 166/302

[58] Field of Search ..... 162/65, 61, 62, 49; 210/747, 758, 761, 766; 166/302, 300

[56] References Cited

U.S. PATENT DOCUMENTS

| | | | |
|---|---|---|---|
| 3,464,885 | 9/1969 | Land et al. | 162/17 |
| 3,853,759 | 12/1974 | Titmas | 210/63 |
| 4,272,383 | 6/1981 | McGrew | 210/741 |
| 4,377,205 | 3/1983 | Retallick | 166/302 |
| 4,705,113 | 11/1987 | Perkins | 166/302 |
| 4,744,908 | 5/1988 | Peterscheck et al. | 210/761 |
| 4,774,006 | 9/1988 | Kaufmann | 210/761 |

OTHER PUBLICATIONS

Chapter 7, "Bleaching of Pulp", 3rd Ed., Rev., Edited By Rudra P. Singh, Technical Association of the Pulp and Paper Industry, Inc., One Dunwoody Park, Atlanta, Ga. 30338, 1979.

*Primary Examiner*—Steve Alvo

*Attorney, Agent, or Firm*—Renner, Kenner, Greive, Bobak, Taylor & Weber

[57] ABSTRACT

A fluid is continously processed by being fed to the top of a hydraulic downdraft tube (15) which forms a downdraft column which is of a height such that the pressure at the bottom thereof will approximately be at the pressure necessary to dissolve sufficient oxygen in water to control the surgical oxidation of lignite in paper pulp in concert with proper retention time and predetermined temperature high and low limits. The fluid is conducted to the bottom of the tube (15) and treated in a variable depth reaction zone (25) in which turbulence is introduced with an injected mixture of reactant and non-reactant gases. The result is that lignite in the pulp will be bleached releasing a controlled proportion of heat to the fluid which enhances the reaction. The treated fluid is fed into an updraft annulus (26) wherein the reaction is selectively restrained by variable depth cooling device (21) and the non-reacting gas is allowed to expand inducing controlled updraft velocities. The flow rate is further controlled without pumping or restricting valving by a hydraulic head imposed on the outlet (28) by a hydraulic column in a tank (31) artificially created through a membrane (39), the height of which is controlled by a non-contaminating fluid (38). The rate of flow away from the apparatus may be independently hydraulically controlled by a float system (68).

7 Claims, 4 Drawing Sheets

METHOD FOR OXYGEN BLEACHING PAPER PULP

TECHNICAL FIELD

This invention relates to a method and apparatus to effect the oxygen bleaching of pulp in the paper industry. More particularly, this invention provides for the continuous processing of the pulp without contacting the pulp with pumps or restrictive throttles. Moreover, this invention provides for the control of such parameters as temperature, oxidation, reaction duration, and the like so that the various parameters can be altered to satisfy variations in the recipes for differing papers.

BACKGROUND ART

It has long been known that paper pulp can be bleached using chlorine as the primary oxidant. However, the bleaching of paper pulp with chlorine, while still widely practiced, has come in disfavor due to the discovery of the presence of 2,3,7,8 TCDD (Dioxin) and 2,3,7,8, TCDF (Furan) in the waste products of chlorine bleached pulp. These two undesired by-products are believed to be cancer causing chemicals when present in detectable levels. Attempts to destroy these particulates, even with supercritical wet oxidation, may not be adequate to reduce the concentration of these particulates to acceptable levels. As a result, efforts have been made to replace chlorine bleaching with oxygen bleaching.

Known methods of bleaching with oxygen have not provided satisfactory results due to the inefficient batch nature of processing as well as the intensive mechanical nature of system pumps which tend to damage the pulp. Additionally, these systems have problems with product inconsistency, tank short circuiting, and difficulties relating to the doubly heterogeneous mixtures of pulp, water, and oxygen, the end product being either under oxidized or over oxidized. Thus, because of the damage done to the cellulose and hemi-cellulose envelope due to the intensive mechanical nature of, and the inconsistent oxidation by, these processes, such have not gained significant acceptance.

Recently, many pumped and batch tank processes have been replaced by hydraulic column or gravity pressure vessel devices. These methods are continuous in nature but existing art has not addressed the needs of paper pulp bleaching. Typical of these processes are disclosed in Land et al. U.S. Pat. No. 3,464,885 and Titmas U.S. Pat. No. 3,853,759, both of which teach continuous gravity pressure vessels for processing mixtures of fluids and solids in suspension. Both, however, do not teach more than the introduction of heat to induce pyrolytic reaction and neither disclose a method or apparatus which can provide for the temperature controls and enhanced mass transfer of oxygen into solution necessary for the surgical control of oxidation bleaching.

One gravity pressure vessel patent, McGrew U.S. Pat. No. 4,272,383, does provide a fixed general cooling capability using an oil heat exchanger, but it does not provide cooling at variable positions within the vessel adequate for the needs of paper bleaching. Paper bleaching is optimized between 200° F. and 300° F. and such control capability could not exist in the McGrew apparatus.

Moreover, the McGrew, Land, and Titmas patents all involve control throttles that would mechanically damage the fragile cellulose fiber and all teach the use of pumping devices for start up and circulation. In addition, the use of steam heat, as contemplated by the Land and Titmas patents at the high pressures desired for the mass transfer of oxygen into solution, would cause the mix to be so hot so as to seriously damage the cellulose fiber and its hemi-cellulose sheath. The McGrew patent discloses the optimization of heating to the saturation temperature of steam and water, which, like Land and Titmas, would destroy the fragile cellulose composition thereby forming carbohydrates, starches and undesirable byproducts.

Thus, the unique needs of the bleaching of paper pulp go unresolved and the industry struggles for an environmentally sound and efficient means to bleach pulp.

DISCLOSURE OF THE INVENTION

It is thus a primary object of the present invention to provide a method and apparatus for the continuous bleaching of paper pulp in a gravity pressure vessel.

It is another object of the present invention to provide a method and apparatus, as above, which controls the parameters of temperature, oxygen in water content, and pulp detention time without interrupting production.

It is an additional object of the present invention to provide a method and apparatus, as above, in which the chemical reaction may be curtailed by cooling the material being processed at adjustable locations within the system.

It is a further object of the present invention to provide a method and apparatus, as above, which can accomplish cooling and mixing by injecting chilled water at an adjustable depth within the system.

It is a still further object of the present invention to provide a method and apparatus, as above, which can accomplish cooling without dilution by means of a heat sink selectively positionable within the system.

It is an additional object of the present invention to provide a method and apparatus, as above, which can control the rate of flow and induce passive mixing by the injection of a non-reactive gas into the gravity pressure vessel at a variable depth.

It is yet another object of the present invention to provide a method and apparatus, as above, which can control the rate of flow in the system by means of a hydraulic head on the outlet of the device.

It is another object of the present invention to provide a method and apparatus, as above, in which the hydraulic head on the outlet of the gravity pressure vessel is induced in concert with the depth or amount of non-reactive gas injection.

It is a still further object of the present invention to provide a method and apparatus, as above, in which there is an independent control of the exiting of process fluids from the gravity pressure vessel and the exiting of process fluids from the induced head hydraulic chamber.

These and other objects of the present invention, which will become apparent from the description to follow, are accomplished by the improvements hereinafter described and claimed.

In general, the method and apparatus for continuously bleaching paper pulp includes a first vertical passageway receiving the fluid material to be processed near the top thereof, a second vertical passageway receiving the fluid material at the bottom thereof from the bottom of the first vertical passageway. A reaction zone is created near the bottom of the passageways, the location of which being controlled by the position that oxygen is injected into the material in the first vertical passageway. The reaction may be inhibited, thus defining the end of the reaction zone, by cooling the material at a selected location within the second vertical passageway. The rate of flow of the material in the first and second passageways can be controlled by imposing a hydraulic head on the material as it is leaving the top of the second vertical passageway. The rate of flow of the processed fluid away from the apparatus is controlled independently from the rate of flow in the first and second passageways. Both flow rates are managed without benefit of pumps or flow restricting valves.

PREFERRED EMBODIMENT FOR CARRYING OUT THE INVENTION

Figure 1:
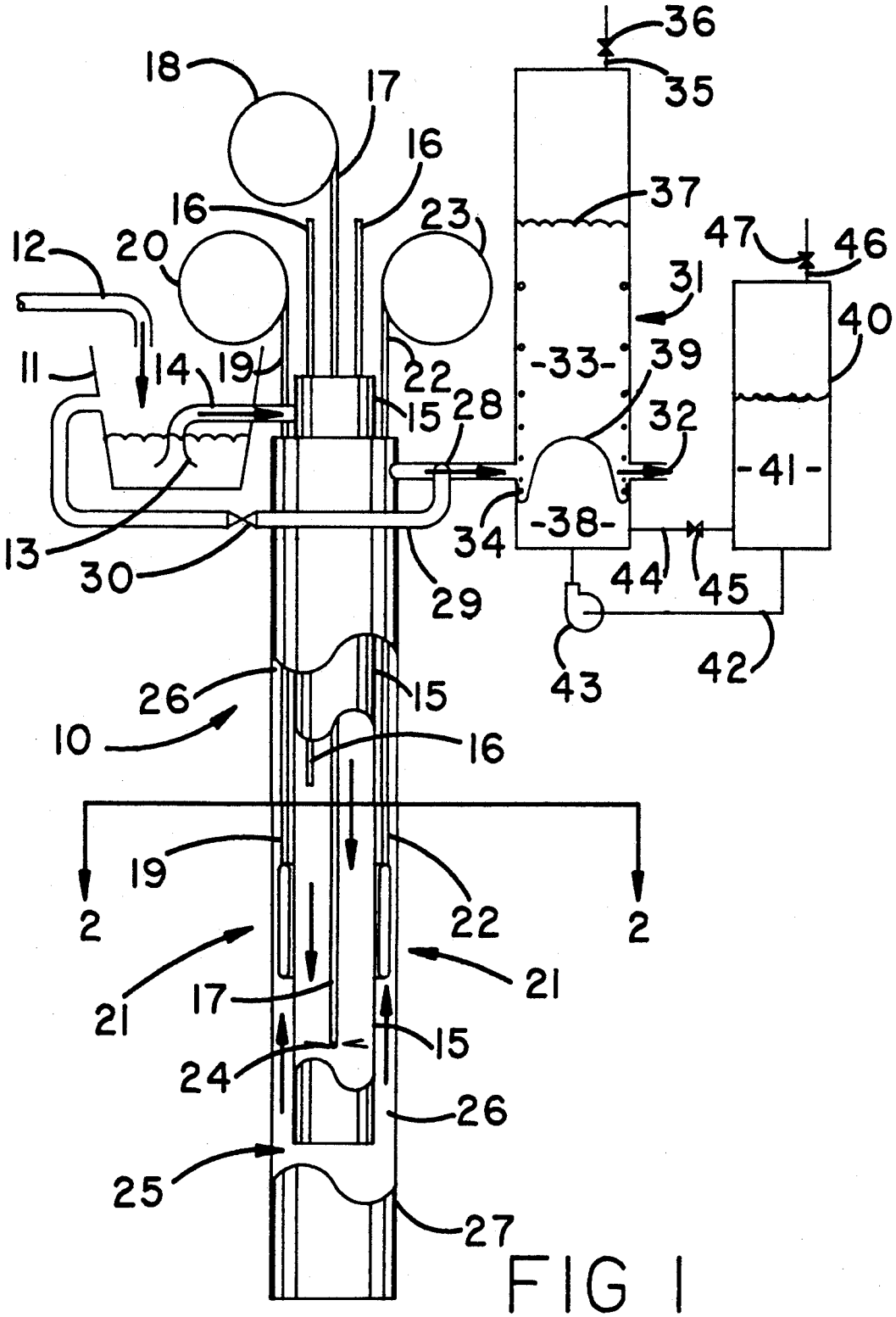
FIG. 1 is a schematic view of the gravity pressure vessel and its outlet control apparatus according to the present invention.

The apparatus for the continuous bleaching of paper pulp is shown in the form of a hydraulic column and indicated generally by the numeral 10 in FIG. 1. A supply tank 11 is provided to receive a mixture of water and pulp from a feed pipe 12. A typical mixture is approximately one to ten percent wood pulp that has been washed of about eighty percent of its original lignin. The pulp is maintained in a mixed condition in tank 11, is swept into an intake bell 13 and is delivered to a pipe 14 by the suction draw of the gravity pressure vessel 10. It enters vessel 10 in a downdraft column defined by tube 15. Conditioners such as pH modifiers, initial oxygen, or metal ions may be introduced, as desired, at a preselected depth via tubes 16. Oxygen and the non-reactive gas used for gas lift in the system may be introduced into the down drafting mix in tube 15 by a probe 17 which is fed downwardly within tube 15 from a conventional drum reel feed 18. The injection depth is thereby fully adjustable as required to balance flow rate and the interrelated detention time to effect oxygen bleaching.

The oxidation reaction may be arrested, as desired, by the introduction of coolant through tube 19. Like probe 17, tube 19 is carried on a conventional drum reel 20 and thus the position of the introduction of a coolant in downdraft tube 15 may be adjustably controlled. The coolant may be chilled water injected directly into the stream or, if desired and as shown, the coolant may be passed through tube 19 to a closed heat sink, indicated generally by the numeral 21, and returned to the surface via tube 22. Tube 22 is carried by a conventional drum reel 23 and is thereby retracted or advanced by the turning of drum reel 23. Drum reel 20 and drum reel 23 must act in concert so as to position tubes 19 and 22 at identical depths within the system.

Figure 2:
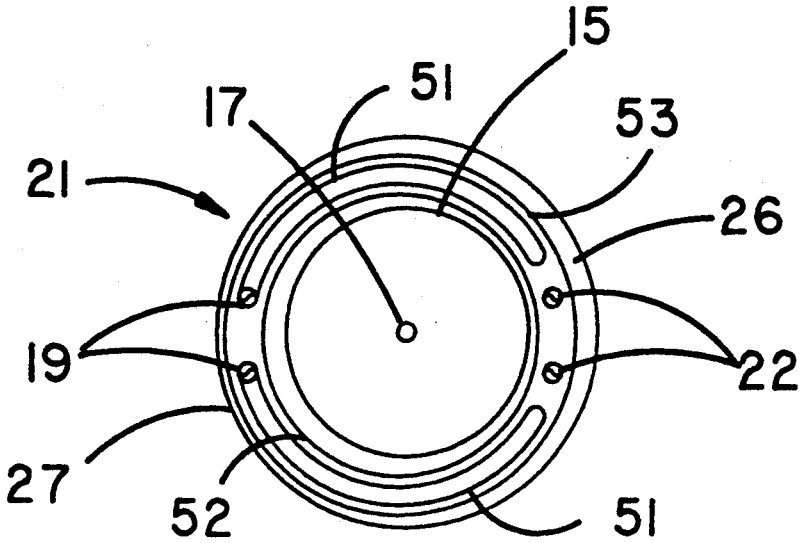
FIG. 2 is an enlarged sectional view taken generally along line 2—2 of FIG. 1 and showing the adjustable depth heat sink utilized for cooling the process.
Figure 3:
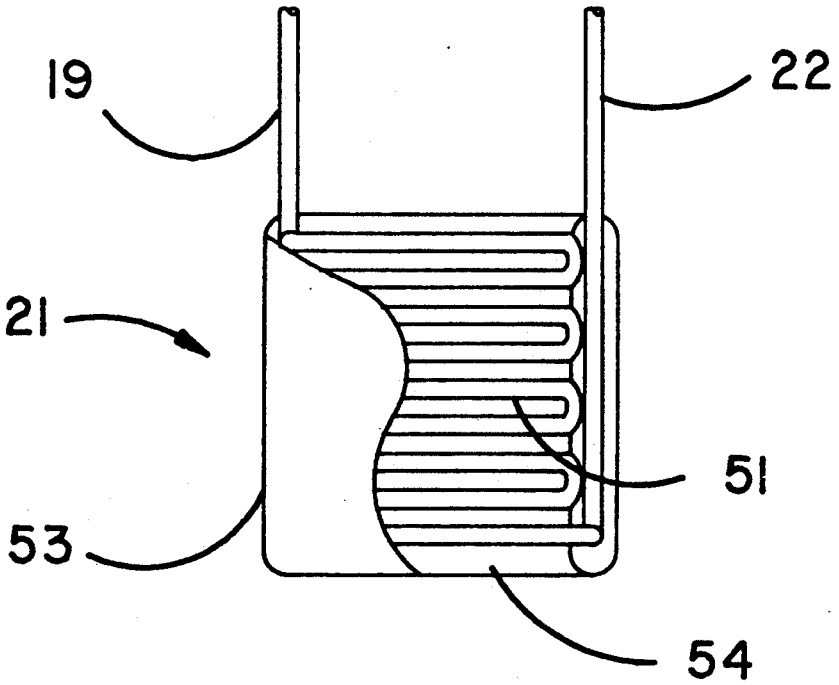
FIG. 3 is a somewhat schematic partially cutaway elevational view of the adjustable depth heat sink shown in FIG. 2.

As best shown in FIGS. 2 and 3, heat sink 21 rides in an updraft annulus 26 defined by the space between tube 15 and outer casing 27 positioned concentrically therewith, and is streamlined so as not to interfere with the flow rate or catch the fibers in the mix. Chilled water introduced via tubes 19, as previously described, feeds cooling "u" tubes 51 within jackets 52 and 53. Tubes 51 absorb heat which leaves the heat sink via tubes 22. A heavy heat transfer filler 54 assists in the transfer of heat from jacket 53 to "u" tubes 51.

The introduction of the oxygen and the non-reactive gas through probe 17 is at the end thereof, as at point 24, which defines the primary reaction zone, generally indicated by the numeral 25, within tube 15. Reaction zone 25 generally begins at point 24, that is, the point of oxygen introduction, and generally ends at the point of cooling in annulus 26, as by heat sink 21 or, alternatively, the point of direct injection of a coolant. The depth of point 24 is fully adjustable at will without interruption of the process by the turning of drum reel 18. By lowering injection point 24, the net gas lift is increased and the flow rate is increased due to the net difference in total pressure between a heavier downdraft and a lighter updraft. A faster flow rate reduces the net process detention time of the pulp with the result being that the tonnage of processed pulp is increased. Also, by controlling the detention time, different paper making recipes can be effected without interrupting production.

The processed pulp mix is thus provided in updraft annulus 26. While in many gravity pressure vessels the downdraft annulus is positioned outside of, that is, around the updraft annulus, in the present invention it is preferable that the downdraft is inboard of the updraft, which by its nature is more convenient because of the introduction of the plurality of probes such as tubes 16 and probe 17 in downdraft tube 15. Moreover, by positioning these members in the downdraft stream, no open end thereof is juxtaposed to the flow direction of the fibers which would cause fouling of the annulus. It should also be noted that since cooling of the pulp is of principal importance, the fact that the warmer material is on the outside enhances heat loss to the strata which normally surrounds the outer casing of a typical gravity pressure vessel. While in some gravity pressure vessel operations heat loss to the strata is undesirable, and, in fact, steps are taken to prevent it, in the present situation strata heat loss is not critical as the reaction temperature range desired is only between 200° F. and 300° F., and the nominal depth to provide the preferred 1000 pounds per square inch for oxygen mass transfer is 2300 feet. At that combination of temperature and depth, heat loss to the strata is of no significant consequence.

The processed pulp mix thus flows upwardly in annulus 26 and exits gravity pressure vessel 10 through pipe 28 which communicates with the top of updraft annulus 26. A return pipe 29 communicates with pipe 28 to protect the gravity pressure vessel from flow interruption. A normally closed valve 30 in pipe 29 will open in the event sensors detect that the pulp level in tank 11 falls too low. In that event, treated pulp will merely be recirculated through the system.

In normal operation, however, the treated pulp is provided from outlet pipe 28 to a tank generally indicated by the numeral 31 and it is ultimately discharged from tank 31 through outlet 32. The pulp which is in tank 31 is indicated by the numeral 33 and may be mixed by a conventional air bubbler pipe ring 34. Gasses in pulp 33 from the mixed oxygen, non-reactive gas, and the gasses resulting from pulp bleaching are discharged from tank 31 through a pipe 35 having a valve 36 therein. The level of pulp 33 in tank 31 is indicated by the numeral 37 and is controlled by the influence of water 38 pumped into tank 31 below a membrane 39. A tank 40 serves as a holding tank for water 41. A pipe 42 conveys water 41 to a pump 43 which conveys the water to establish a quantity of water 38 under the flexible membrane 39 causing pulp 33 to rise with the resulting hydraulic head thereby restricting the flow rate within the gravity pressure vessel 10. When it is desired to lower pulp level 37, a pipe 44 conveys water 38 back to tank 40 through valve 45. A vent pipe 46, which is provided with a valve 47, allows tank 40 to breathe.

Figure 4:
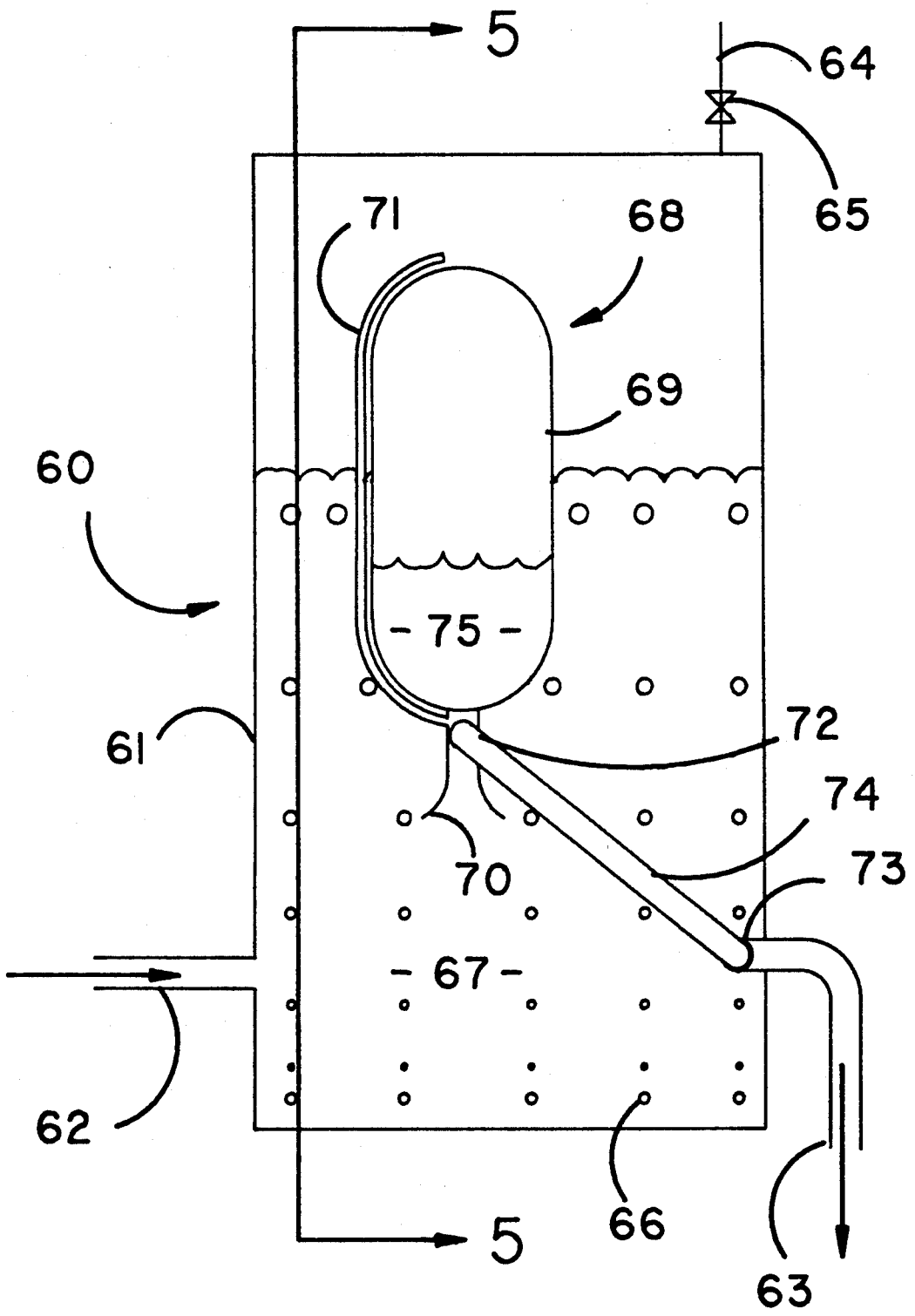
FIG. 4 is a somewhat schematic elevational view of the apparatus which independently controls the flow rate in the system.
Figure 5:
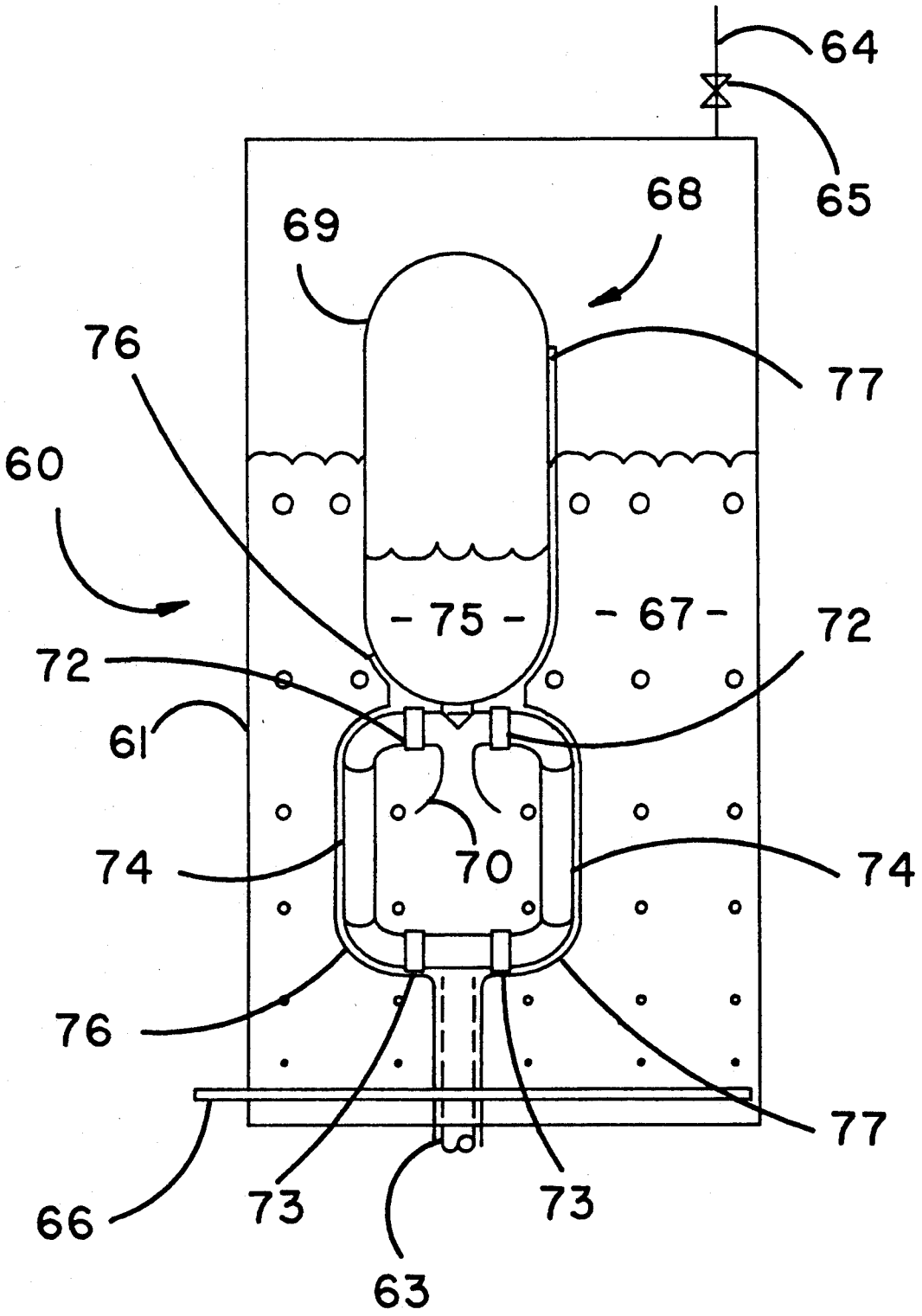
FIG. 5 is a sectional view taken generally along line 5—5 of FIG. 4.

The device to independently control the flow rate out of the system is generally indicated by the numeral 60 and shown in FIGS. 4 and 5. A tank 61 receives pulp through pipe 62 which communicates with outlet pipe 32 of tank 31 shown in FIG. 1. Tank 61 has an outlet pipe indicated at 63 and also includes a number of conventional items. For example, a vent pipe 64 with valve 65 similar to vent pipe 46 and valve 47 of tank 31 also serve tank 61. In addition, a multiplicity of conventional bubblers 66 cause the pulp 67 in tank 61 to be mixed and equalized. Pulp 67 is, of course, at the same level in tank 61 as the level 37 of pulp 33 in tank 31.

A float assembly, generally indicated by numeral 68, floats within pulp 67 at a level independently controlled in a manner to be hereinafter described. A floating chamber 69 carries but does not communicate with a pulp uptake bell 70 equipped with a conventional vacuum breaker 71. Swivel connections 72 and 73 at uptake bell 70 and outlet pipe 63, respectively, allow open channel flow pipes 74 to transport pulp 67 to outlet 63 without being affected by the movement of float chamber 69. The level of water 75 in float chamber 69 is fully adjustable, which causes uptake 70 to increase or decrease flow depending on its depth in pulp 67 in tank 61. That is, by increasing the amount of water 75 in the float chamber 69, the chamber is lowered within pulp 67 and the flow rate is increased. Conversely, decreasing the amount of water 75 in float chamber 69 will decrease the flow rate of the pulp through outlet pipe 63. The level of water 75 is controlled by a water feed tube 76 and an air tube 77. By providing water to float chamber 69 through tube 76 and venting air through tube 77, float chamber 69 sinks in pulp 67 and the outlet flow rate via bell 70, pipes 74, and outlet 63 is controlled with complete independence from the flow rate through the gravity pressure vessel 10 of FIG. 1.

Thus, an apparatus and processing method is described herein where there is complete system control on a continuous basis without taking the apparatus out of service. All of the significant paper production recipe requirements may be controlled by the system. These requirements include mixing, equalization, peak temperature, time-temperature duration, degree of oxidation, heating, cooling, flow rate, activators and inhibitors, are all accomplished without the damaging effects of pumping or restrictive valving. It should thus be evident that the objects of the present invention are accomplished and the paper pulp processing art substantially improved.

I claim:

1. A method of oxygen bleaching a continuously flowing fluid paper pulp comprising the steps of feeding the fluid paper pulp to the top of a first vertical passageway having a top and a bottom, conducting the fluid paper pulp from the bottom of the first vertical passageway to the bottom of a second vertical passageway having a top and a bottom, initiating a reaction in a zone near the bottom of the first vertical passageway by injecting oxygen in the fluid paper pulp in the first vertical passageway, controlling the position of the reaction zone and the flow rate of the fluid paper pulp in the first and second passageways by adjusting the position of the injection of oxygen within the first vertical passageway during the oxygen bleaching, and removing the fluid paper pulp treated in the reaction zone from the top of the second vertical passageway, wherein the rate of flow of the processed fluid away from the apparatus is controlled independently of the rate of flow of the fluid paper pulp in the first and second passageways, and both rates of flow are managed without the benefit of pumps or flow restricting valves.

2. A method according to claim 1 wherein the controlled injection of oxygen is effected by positioning a probe capable of releasing oxygen into a preselected position within the first vertical passageway.

3. A method according to claim 1 further comprising the step of inhibiting the reaction in the reaction zone by cooling the fluid paper pulp in the second vertical passageway.

4. A method according to claim 3 wherein the cooling of the fluid paper pulp in the second vertical passageway is accomplished by injecting a coolant fluid at a preselected position within the second vertical passageway.

5. A method according to claim 3 wherein the cooling of the fluid paper pulp in the second vertical passageway is accomplished by introducing a heat sink at a preselected position within the second vertical passageway.

6. A method according to claim 1 further comprising the step of controlling the flow rate of the fluid paper pulp in the first and second vertical passageways by creating a hydraulic head in communication with the treated fluid paper pulp being removed from the top of the second vertical passageway.

7. A method according to claim 1 further comprising the step of controlling the rate that the treated paper pulp is being removed from the top of the second vertical passageway.

* * * * *